US005389937A

United States Patent [19]

Kaloi

[11] Patent Number: 5,389,937

[45] Date of Patent: Feb. 14, 1995

[54] WEDGE FEED SYSTEM FOR WIDEBAND OPERATION OF MICROSTRIP ANTENNAS

[75] Inventor: Cyril M. Kaloi, Thousand Oaks, Calif.

[73] Assignee: The United States of America as represented by the Secretary of the Navy, Washington, D.C.

[21] Appl. No.: 605,737

[22] Filed: May 1, 1984

[51] Int. Cl.[6] ..... H01Q 1/26

[52] U.S. Cl. ..... 343/700 MS

[58] Field of Search ..... 343/700 MS, 846, 830, 343/729

[56] References Cited

U.S. PATENT DOCUMENTS 4,370,657 1/1983 Kaloi ..... 343/700 MS 4,401,988 8/1983 Kaloi ..... 343/700 MS

*Primary Examiner*—Theodore M. Blum

*Attorney, Agent, or Firm*—David Kalmbaugh; Melvin Swilka; John Forrest

[57] ABSTRACT

The microstrip antenna system uses a special wedge shaped feed connected from the antenna radiation element to the center pin of the coaxial to microstrip adapter to obtain wide bandwidth operation. The special wedge feed connects the center pin to an indefinite series of feedpoints along the length of radiating element. The angle of the taper of the wedge feed along with the distance between the bottom of the wedge and the ground plane provides impedance matching for the antenna.

11 Claims, 3 Drawing Sheets

Fig. 3a.
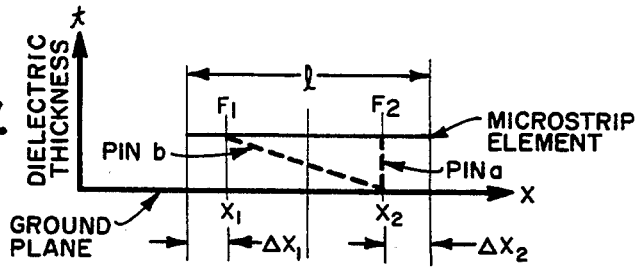
Fig. 3b.
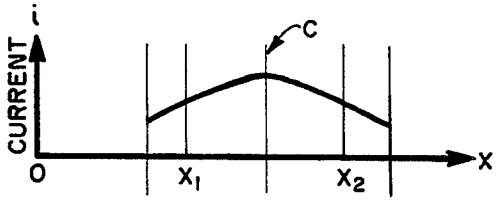
Fig. 3c.
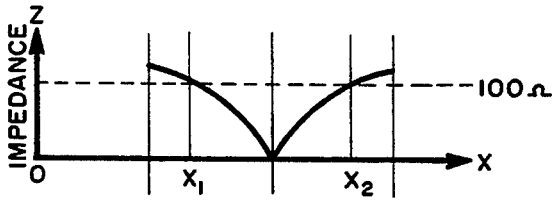
Fig. 3d.
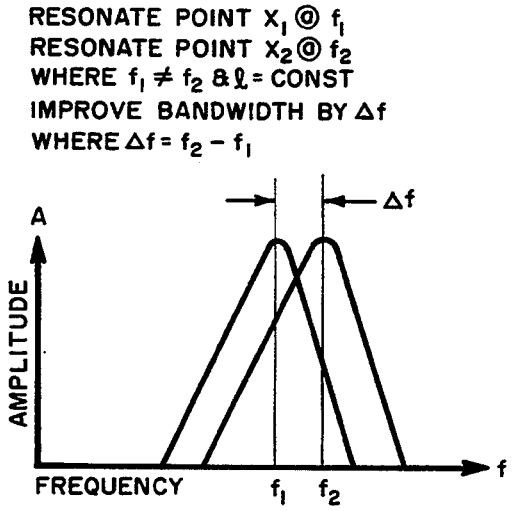
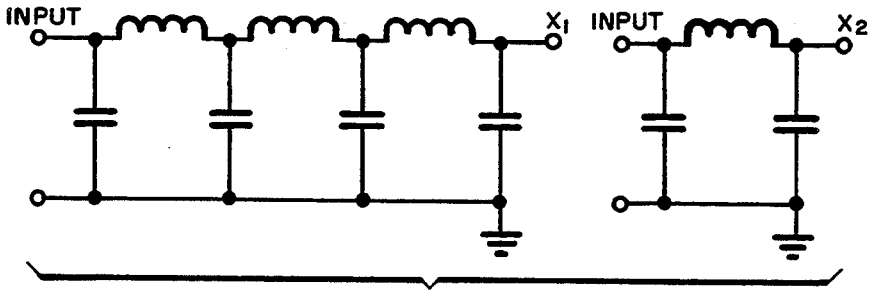
Fig. 4.

WEDGE FEED SYSTEM FOR WIDEBAND OPERATION OF MICROSTRIP ANTENNAS

BACKGROUND OF THE INVENTION

This invention relates to microstrip antennas and more particularly to a technique for feeding microstrip antennas to obtain wider bandwidths than obtained in prior single element microstrip antennas.

For most applications using thin microstrip antennas, it is very difficult to produce antennas that have very wide bandwidth. Microstrip antennas by nature are limited in bandwidth to approximately 1% to 5% depending on the thickness of dielectric separating the ground plane from the element Previously, the use of thicker and larger antennas that protrude above the aircraft skin was necessary in order to obtain wide band performance. Another approach was to use a plurality of microstrip antenna elements stagger tuned to provide the bandwidth desired; however, such approach is sometime undesirable since it also produces complex radiation patterns.

The present invention uses a technique that provides bandwidth improvement to approximately 30%. The feeding technique of the present invention can be used with any of a variety of microstrip antennas, such as disclosed in: U.S. Pat. No. 3,972,049 for Asymmetrically Fed Electric Microstrip Dipole Antenna; U.S. Pat. No. 3,978,488 for Offset Fed Electric Microstrip Dipole Antenna; U.S. Pat. No. 3,984,834 for Diagonally Fed Electric Microstrip Dipole Antenna; U.S. Pat. No. 4,370,657 for Electrically End Coupled Parasitic Microstrip Antennas; as well as other adaptable microstrip antennas. By using the techniques of this invention, a less expensive microstrip antenna can be made to meet broadband requirements that more expensive or more complex microstrip antennas cannot meet. This invention can extend the VSWR bandwidth of an existing microstrip antenna system by more than a factor of four.

SUMMARY OF THE INVENTION

The wedge feed system for microstrip antennas is intended to allow a single microstrip antenna system with one common input to provide a wider bandwith than prior equivalent microstrip antenna systems. The present microstrip antenna system uses a special wedge feed to obtain wide bandwidth operation. The radiation element is photo-etched in the same manner as other microstrip antennas, and a wedge shaped feed is connected from the antenna radiation element to the center pin of the coaxial to microstrip adapter, which is mounted on the ground plane. The angle of the taper of the wedge feed along with the distance between the bottom of the wedge and the ground plane provides impedance matching for the antenna. Although a rigorus theory for the wedge feed system has not been developed, a simplified theory along with experimental studies has provided an insight into the effects of the more important parameters and has allowed judicious selection of these parameters in designing wide bandwidth microwave antennas.

It is an object of the invention, therefore, to provide a simplified system for wideband operation of microstrip antennas.

Another object of the invention is to provide a single microstrip antenna system with a single common input to provide a wider bandwidth than prior equivalent microstrip antenna systems.

Further it is an object of the invention to provide a special wedge feed system to obtain wide bandwith operation of microstrip antennas.

Other objects, advantages and novel features of the invention will become apparent from the following detailed description of the invention when considered in conjunction with the accompanying drawings wherein:

BRIEF DESCRIPTION OF THE DRAWINGS

FIGS. 3*a*, 3*b*, 3*c* and 3*d* shown curves used in explaining the theory and operation of the wedge feed system of the present invention.

FIG. 4 shows an equivalent circuit for a wedge feed.

DESCRIPTION OF THE PREFERRED EMBODIMENT

Figure 1A:
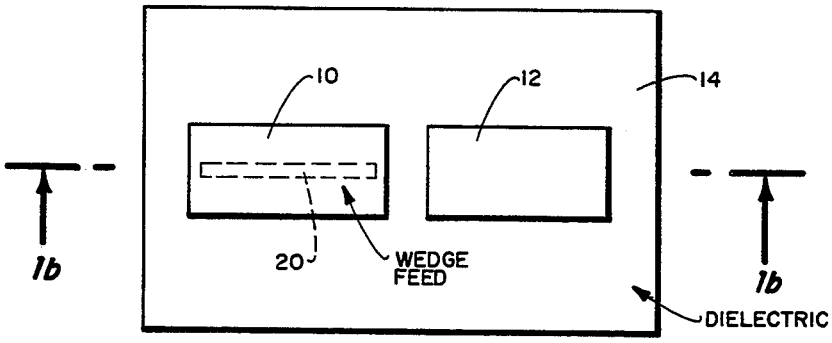
FIG. 1*a* is a planar view.
Figure 1B:
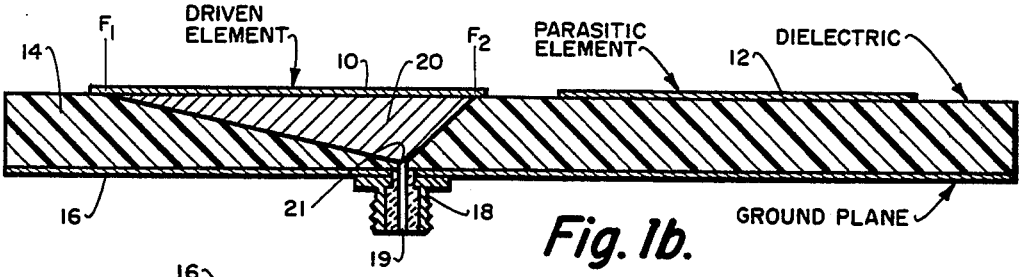
FIG. 1*b* is a cross-sectional view along line 1*b*—1*b* of FIG. 1*a*, and 1*c* is a bottom view, respectively, illustrating a typical microstrip antenna using a wedge feed system of the present invention.
Figure 1C:
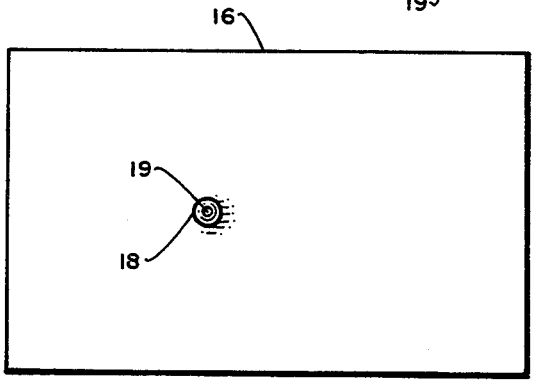

FIGS. 1*a*, 1*b* and 1*c* show a typical electrically end coupled parasitic microstrip antenna which is fed with the wedge feed system of the present invention. An end coupled parasitic microstrip antenna is described by way of example although the wedge feed system will operate with other microstrip antennas as indicated above, e.g. asymmetrically fed, diagonally fed, edge fed, etc. The parasitic microstrip antenna illustrated has two radiating elements 10 and 12 formed on a dielectric substrate 14 which separates the radiating elements 10 and 12 from ground plane 16. Radiating element 10 is fed from a coaxial-to-microstrip adaptor 18 whose center pin 19 is connected to a special wedge feed 20 at its apical end 21. Wedge feed 20 in turn extends and is connected to element 10 along a substantial portion of the element length, as shown in FIGS. 1*a* and 1*b*. In effect, wedge feed 20 connects the center pin 19 to an indefinite series of feedpoints along the length of radiating element 10, rather than to just a single feedpoint. The location of apical end 21 along the length of wedge 20 can vary with antenna parameters. The threaded portion of Coaxial adapter 18 is connected to ground plane 16. Radiating element 12 is parasitically fed, as is typically described in U.S. Pat. No. 4,370,657.

The microstrip antenna radiating elements are photo-etched in the usual and well-known manner for producing microstrip antennas. A slot, the size and shape of the wedge feed 20, is then cut in radiating element 10 and dielectric 14 and the wedge feed is fitted in the slot as shown in FIGS. 1*a* and 1*b*. The wedge feed 20 is electrically connected to the radiation element 10 by brazing, soldering, etc., and connector pin 19 connected at 21.

Figure 2A:
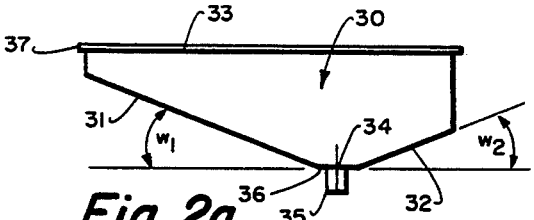
FIGS. 2*a* and 2*b* are side and bottom views, respectively, which show a variation in the configuration of a wedge feed for a microstrip antenna system.
Figure 2B:
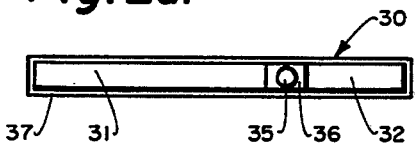

FIGS. 2*a* and 2*b* show a wedge feed 30 for use with microstrip antennas, and having a slightly different configuration than wedge feed 20 shown in FIG. 1*b*. The shape of the wedge feed will vary with antenna requirements, size, bandwidth, etc. It is the angle of the taper of bottom edges 31 and 32 (i.e., angles $W_1$ and $W_2$ on each side of point 34 where a connector pin 35 is attached) along with the distance between the bottom 36 of the wedge and the antenna ground plane that provides impedance matching for the antenna; this also applies to the wedge feed of FIG. 1*a*. Where the angles $W_1$ and/or $W_2$ are small, such as in FIG. 2*a*, the tapered edges 31 and 32 may not intersect with the upper edge 33 of the wedge due to the length of the upper edge being limited by the length of the radiating element. When angles $W_1$ and $W_2$ are very large the upper edge 33 may be substantially shorter than the radiating element. Also, if either $W_1$ or $W_2$ approached 90°, the wedge would take on a general shape as formed by the outline of pin a and pin b in FIG. 3*a*, with only a single lower tapered edge (such as defined by the line designated pin b). Flange 37 is merely provided for ease in assembly of the antenna and connection of the wedge feed to the radiating element.

The height of the wedge feed 20, FIG. 1*b* (or 30, FIG. 2*a*), for example, is dependent upon bandwidth requirements, and the length can be made up to the length of the radiating element, e.g., 10, which it feeds. The height of the wedge feed from its apical end 21, FIG. 1*b* (or 36, FIG. 2*a*) to the radiating element is governed by the thickness of the substrate, and is always less than the substrate thickness. The angles of taper, i.e., $W_1$ or $W_2$, may be the same or differ from each other depending upon antenna requirements. The taper provides both impedance matching and phase matching that allows a wider bandwidth for proper operation. The location of point 21, for example, along the wedge feed length is somewhat determined experimentally. Location of point 21 will vary with different antenna design requirements and can be varied along the wedge length depending upon the radiation pattern and matching desired.

The distance between the apical end 21 of the wedge feed and the ground plane also can be experimentally determined. If the apical end 21 is placed too close to the ground plane, the affect will be an R.F. short. If the apical end is located too far away from the ground plane, the affect will be an unmatched transition from the coaxial adapter 18 to the wedge feed 20. Thickness of the wedge is generally chosen for ease in fabrication and assembly, and any affect on matching due to the thickness can readily be compensated for in adjusting other parameters such as the angle of the taper of lower edges 31 and 32.

The wedge feed operates most efficiently when connected along the centerline of the radiating element as this will avoid higher modes of oscillation; however, where the higher order modes can be supressed, the wedge can be located wherever desired. The substrate thickness (i.e., distance between the radiating element and ground plane), as in other microstrip antennas, is usually much less than ¼ wavelength and is determined by bandwidth, space, etc., requirements.

It is possible to feed a microstrip antenna, as shown in FIGS. 1*a*, 1*b* and 1*c* (disregarding the wedge feed shown), at two (or more) different places, such as at points $F_1$ and $F_2$.

FIGS. 3*a*, 3*b*, 3*c* and 3*d* will be helpful in explaining the operation and some of the theory involved in the present invention. In FIG. 3*a* two feed points $F_1$ and $F_2$ are shown located on a microstrip radiating element of length l positioned a distance (i.e., the dielectric thickness) above a ground plane, each feed point spaced equidistantly from opposite ends of the radiating element. If the microstrip radiating element is fed at either of the two feedpoints on the element (i.e., at point $F_1$ to $X_1$ or at point $F_2$ to $X_2$, where $\Delta X_1 = \Delta X_2$) with exactly the same feed pin/connector adapter, exactly the same electrical antenna characterization will be obtained. This is because the current distribution is symmetrical about the center axis C, of a plot of current vs position along the element, as illustrated in FIG. 3*b*. Since the impedance is inversely proportional to the current, the impedance distribution (as shown plotted in FIG. 3*c*) is also symmetrical about the center axis C. However, if a slanted feed pin b is connected from point $F_1$ to $X_2$ in FIG. 3*a*, the resonate frequency will be lower compared to a feed pin a connected from point $F_2$ to $X_2$. This is as a result of additional inductance incurred due to the additional length of feed pin b changing the center frequency of the antenna. A plot of amplitude vs. frequency (frequency response) for each feed pin (i.e., feed pin a and feed pin b) is shown in FIG. 3*d*. Where $\Delta f$ is the improved bandwidth $$\Delta f = F_2 - F_1$$

and $$\Delta f \propto \Delta L$$

where $\Delta L$ is the incremental change in inductance due to the difference in feed pin length.

If both feed pin a and feed pin b are interconnected at $X_2$ to a single coaxial adapter connector, it is possible to excite with both pins, simultaneously, two modes of oscillation having a constructive rather than destructive interference within the cavity between the radiating element and the ground plane. This simultaneous excitation of two modes of oscillation takes place if the wave front propagated from feed pin a is in phase with the wave front propagated from feed pin b, and the parallel impedance combination looking into each feed pin provides an impedance match to the testing system.

These feed pins (i.e., a and b) can be viewed as two current rods, and the current rods may be represented by an equivalent transmission line circuit. If several current rods are used, this will in the limit approach a wedge feed, and an equivalent circuit of such a wedge feed may be represented by a transmission line circuit such as shown in FIG. 4. Theoretically, there can be an infinite number of paired current rods, where each pair can combine to provide the proper phase and impedance combination. Having an infinite number of paired current rods will in the limit approach a current wedge.

FIGS. 1*a*, 1*b* and 1*c* have been used to illustrate a typical microstrip antenna using a wedge feed inserted between the radiating element and the ground plane to obtain wide bandwidth. A typical microstrip antenna as shown in FIGS. 1*a*, 1*b* and 1*c*, but using a coaxial adapter connected to only a single feedpoint is shown and described in U.S. Pat. No. 4,370,657, aforementioned. The microstrip antenna illustrated in FIGS. 1*a*, 1*b* and 1*c* has been used by way of example only, and the wedge feed system described herein is not limited to that particular type of microstrip antenna. The wedge feed system can also be used with other suitable microstrip antennas as previously indicated.

Figure 5A:
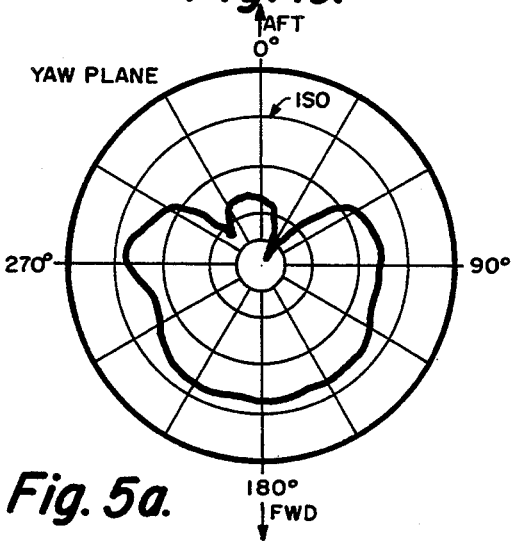
FIGS. 5*a* and 5*b* show Yaw Plane and Pitch Plane radiation patterns, respectively, for a typical microstrip antenna using a wedge feed system of this invention.
Figure 5B:
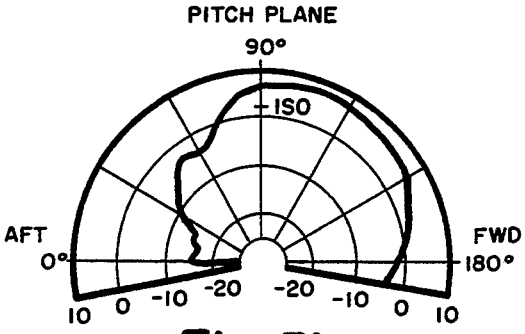
Figure 6:
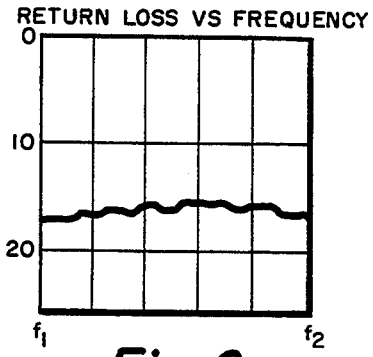
FIG. 6 is a curve showing a typical Return Loss vs Frequency measurement for a microstrip antenna using the wedge feed system of the present invention.
Figure 7:
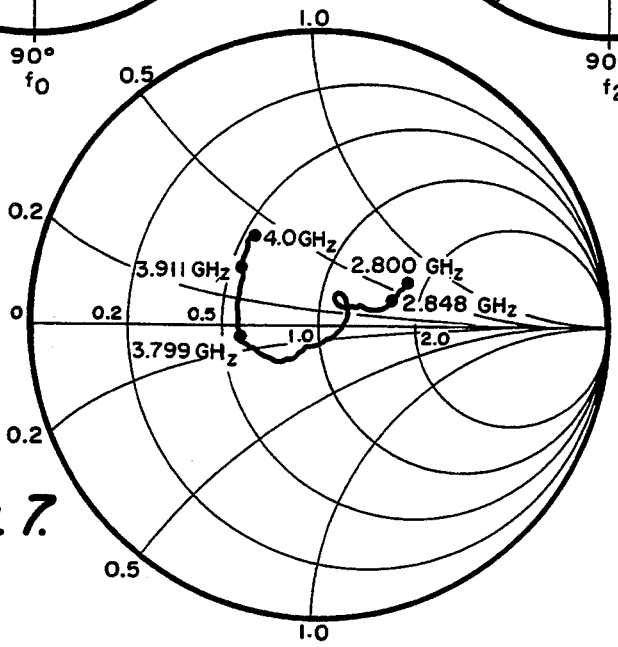
FIG. 7 shows a typical Complex Impedance Plot for a microstrip antenna system using the wedge feed system of this invention.

Requirements for a typical microstrip antenna for air-borne application, for example, using a wedge feed system are: VSWR 2:1; bandwidth 2.8 $GH_3$–4.0 $GH_3$; substrate thickness 0.374" max; ground plane length $<20\lambda$; ground plane width $\approx 2\lambda$; antenna flush mounted with ground plane; with pattern requirement for Yaw Plane and Pitch Plane shown in FIGS. 5*a* and 5*b*, respectively. Such requirements would normally use a two element parasitic array design such as described in U.S. Pat. No. 4,370,657. However, that design would be limited to a VSWR (2:1) bandwidth of approximately 250 Mhz. Using a wedge feed system, as disclosed herein, in a similar two element parasitic array design will provide a Radiation Pattern bandwidth of approximately 500 Mhz. and a VSWR (2:1) bandwidth of approximately 1200 Mhz. FIG. 6 shows a typical Return Loss vs. Frequency measurement, and FIG. 7 shows a typical Complex Impedance Plot.

Figure 8:
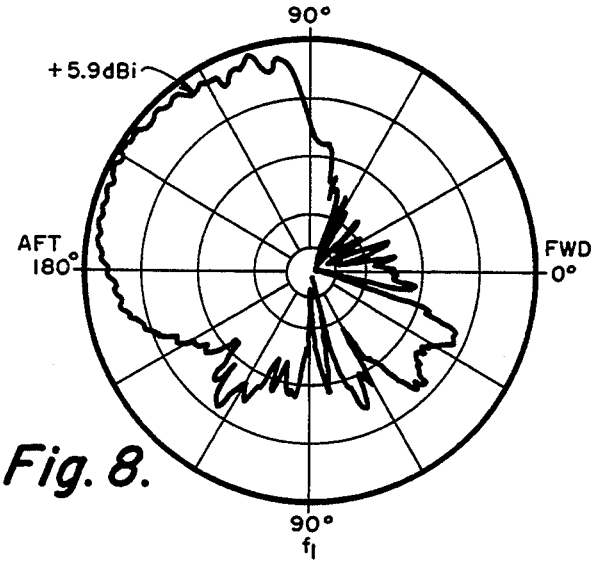
FIGS. 8, 9 and 10 illustrate typical radiation pattern (pitch plane) plots for a wedge fed microstrip antenna of the present invention, at three different frequencies: $f_1$, $f_0$ and $f_2$, respectively.
Figure 9:
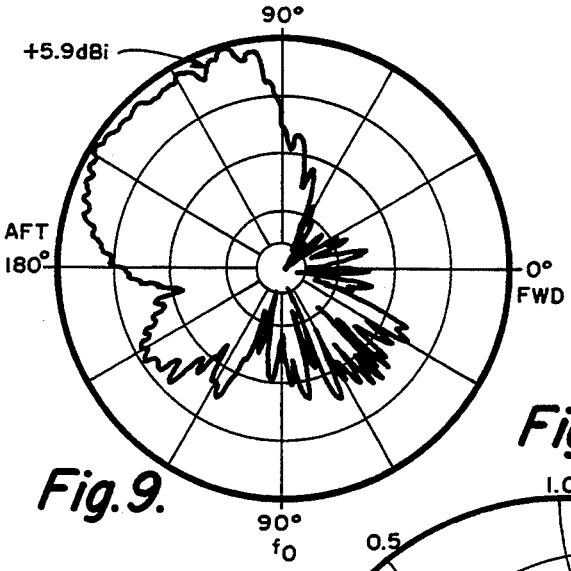
Figure 10:
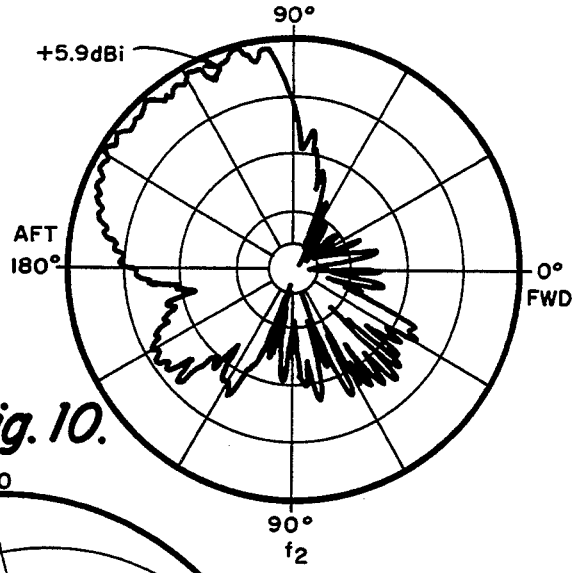

FIGS. 8, 9 and 10 illustrate typical radiation pattern (pitch plane) plots for a typical wedge fed microstrip antenna over a bandwidth of 500 MHz, such as shown in FIGS. 1*a*, 1*b* and 1*c*, for $f_1$, $f_0$ and $f_2$, respectively, showing relative uniformity in the patterns. Radiation pattern plots for other wedge fed microstrip antennas would be similar.

While a flat or straight wedge is described herein, other tapers such as in cones, prolated spheroids, curved and S-shapes can be beneficial in some cases where higher order modes of excitation are desired for wideband application.

Obviously, many modifications and variation of the present invention are possible in light of the above teachings. It is therefore to be understood that within the scope of the appended claims the invention may be practiced otherwise than as specifically described.

What is claimed is:

1. A wide bandwidth microstrip antenna, comprising:

a. a thin ground plane conductor;

b. a thin radiating element for producing a radiation pattern being spaced parallel to and electrically separated from said ground plane by a dielectric substrate;

c. a wedge shaped feed conductor mounted within said dielectric substrate and connected to said radiating element;

d. said wedge shaped feed comprising an upper edge, and two lower tapered edges which meet at an apical point; the height of said wedge shaped feed being less than the thickness of said dielectric substrate;

e. said wedge shaped feed being connected along its upper edge to said radiating element for feeding the radiating element at an indefinite series of feedpoints along the radiating element length;

f. a single coaxial-to-microstrip adapter mounted on said ground plane for feeding the antenna; the center pin of said adapter extending through the ground plane and connecting to the apical point of said wedge feed;

g. the angle of the said lower tapered edges of said wedge feed with respect to said radiating element and the distance of said apical point from the ground plane operating to provide impedance and phase matching for broad bandwidth antenna operation.

2. A wide bandwidth microstrip antenna as in claim 1 wherein the maximum length of said wedge shaped feed is limited by the length of said radiating element.

3. A wide bandwidth microstrip antenna as in claim 1 wherein the angle of taper of one of said two lower edges of said wedge feed aproaches 90°.

4. A wide bandwidth microstrip antenna as in claim 1 wherein said wedge feed is connected to the radiating element along the radiating element center line.

5. A wide bandwidth microstrip antenna as in claim 1 wherein said wedge shaped conductor is mounted normal to said radiating element.

6. A wide bandwidth microstrip antenna as in claim 1 wherein the maximum height of said wedge shaped feed is determined by the thickness of said dielectric substrate.

7. A wide bandwidth microstrip antenna as in claim 1 wherein the location of said wedge feed apical point and the coaxial-to-microstrip adapter along the antenna length is determined by the matching.

8. A wide bandwidth microstrip antenna as in claim 1 wherein a series of constructive modes of oscillation are set up within the cavity between the radiating element and ground plane which provide improved bandwidth.

9. A wide bandwidth microstrip antenna as in claim 1 wherein said wedge shaped feed is connected to the radiating element along an outer edge of said radiating element.

10. A wide bandwidth microstrip antenna as in claim 1 wherein said wedge shaped feed is connected to the radiating element along a diagonal of said radiating element.

11. A wide bandwidth microstrip antenna as in claim 1 wherein said wedge shaped feed is flat.

* * * * *